US005906297A

United States Patent [19]

Cole

[11] Patent Number: 5,906,297

[45] Date of Patent: May 25, 1999

[54] MULTI-OUTLET DEPOSITOR

[76] Inventor: Russell H. Cole, 16 Francis Rd., Sharon, Mass. 02067

[21] Appl. No.: 08/754,554

[22] Filed: Nov. 21, 1996

[51] Int. Cl.[6] ..... B67D 5/52

[52] U.S. Cl. ..... 222/134; 222/135; 222/333; 222/368; 222/415; 222/483

[58] Field of Search ..... 222/134, 135, 222/145.3, 333, 367, 368, 415, 478, 482, 483

[56] References Cited

U.S. PATENT DOCUMENTS

| | | | |
|---|---|---|---|
| 3,606,965 | 9/1971 | Cortelyou et al. | 222/368 |
| 3,784,335 | 1/1974 | Cevera | 417/539 |
| 4,117,954 | 10/1978 | Pelletier | 222/134 |
| 4,830,230 | 5/1989 | Powers | 222/334 |
| 4,848,218 | 7/1989 | Battagila | 99/450 |
| 4,881,663 | 11/1989 | Seymour | 222/145.3 |
| 4,996,914 | 3/1991 | D'Alterio | 99/450.7 |
| 5,273,188 | 12/1993 | Sanino | 222/482 |
| 5,509,575 | 4/1996 | Gillette | 222/1 |
| 5,513,779 | 5/1996 | Reich | 222/425 |
| 5,536,517 | 7/1996 | Hannaford | 426/516 |
| 5,688,540 | 11/1997 | Hannaford | 425/382 |

FOREIGN PATENT DOCUMENTS

| | | |
|---|---|---|
| 0 061 995 | 3/1982 | European Pat. Off. . |
| 35 45 673 C2 | 12/1985 | Germany . |
| 3426029 A1 | 1/1986 | Germany . |
| 39 23 454 A1 | 7/1989 | Germany . |
| 195 17 127 A1 | 11/1996 | Germany . |

*Primary Examiner*—Joseph A. Kaufman
*Attorney, Agent, or Firm*—Foley Hoag & Eliot LLP

[57] ABSTRACT

A multi-outlet depositor receives fluid material and displaces first and second portions of the material using first and second mechanisms, respectively, that are coupled together in a manner that causes volume of the first portion to vary according to volume of the second portion. The first portion may equal the second portion. The first and second mechanisms may be coupled using a bolt. The multi-outlet depositor may also include an output for providing the first and second portions. The first and second mechanisms may include positive displacement vane pumps. Each of the vane pumps may include a hub/chamber assembly having a hub and a plurality of vanes disposed within a cylinder. The hub/chamber assembly may have two vanes that interlock and are displaceable along their longitudinal axes.

5 Claims, 6 Drawing Sheets

MULTI-OUTLET DEPOSITOR

TECHNICAL FIELD

This application relates to the field of portioning and more particularly to the field of dividing one or more streams of fluid material into a plurality of substantially proportional segments.

BACKGROUND OF THE INVENTION

In many instances, it is desirable to be able to divide one or more streams of fluid material into a plurality of portions having a constant and controllable volume relationship therebetween. For example, as described below, portion size control is desirable in many segments of the food processing industry.

Some commercial food products are manufactured using a commercial grade food processing machine to grind up and mix various ingredients to provide a fluid output having a paste-like consistency. The fluid output is then further processed in order to provide a finished product. Examples of this include cookies, where the food processing machine provides dough having a paste-like consistency that is subsequently baked, and sausage, where the food processing machine provides filler material having a paste-like consistency that is put into each link of the sausage casing.

The material provided by the food processing machine can be carried away via a conveyor belt located at the output of the food processing machine. The stream of output material from the food processing machine can then be subsequently cut with a mechanically driven knife or other suitable means so that the combination of the food processing machine, conveyor belt, and cutting means provides a plurality of substantially equal portions. It is often desirable that the relationship between portions remains constant so that, for example, each cookie is the same size or each sausage link contains the same amount of material.

Increasing the number of portions output by the food manufacturing process can be accomplished by using multiple food processing machines to provide multiple portions simultaneously. However, commercial-grade food processing machines are often very expensive and, in situations where the volume of the output of a single food processing machine is sufficient to provide the desired amount of final product, employing additional machines is not cost-effective.

Another solution is to divide the output of a single food processing machine into multiple streams. There are many known techniques for doing this including providing a multi-port flange at the output of the food processing machine. However, if the material being provided by the food processing machine is not homogenous and/or if the material contains particulate matter, then the multi-port flange solution may be unacceptable since the non-homogenous and/or particulate matter can cause undesirable back pressure to form at one or more of the ports, thus causing other ones of the ports to output a disproportionate amount of material.

In addition, sometimes it is desirable to provide more than one portioned material. In those instances, the size of each segment of the different materials would, ideally, be proportional to the segment size of one of the materials. For example, a food processing operation could provide shredded meat and barbecue sauce in the same package, in which case it would be desirable that the amount in each segment of barbecue sauce be proportional to the amount in each segment of shredded meat.

SUMMARY OF THE INVENTION

According to the present invention, a multi-outlet depositor receives a fluid material and displaces first and second portions of the material using first and second mechanisms, respectively, that are coupled together in a manner that causes volume of the first portion to vary according to volume of the second portion. The first portion may equal the second portion. The first, second, and any subsequent mechanisms may be coupled using a bolt or other suitable locking device. The multi-outlet depositor may also include an output for providing the first and second portions.

The first, second, and any subsequent mechanisms may include positive displacement vane pumps. Each of said vane pumps may include a hub/chamber assembly having a hub and a plurality of vanes disposed within a cylinder. The hub/chamber assembly may have two vanes that interlock and are displaceable along their longitudinal axes.

Portions of the first and second displacement means may rotate in concert, in which case the multi-outlet depositor may also include an axle, attached to the first and second displacement mechanisms to rotate in concert with the first and second displacement mechanisms. The multi-outlet depositor may also include an air brake or the like, attached to the axle, for providing resistance to rotation of the first and second displacement mechanisms. Alternatively, the multi-outlet depositor may also include a motor or the like, attached to the axle, for providing a force to rotate the axle. The fluid material may be a food product and may contain particulate matter.

According further to the present invention, a multi-outlet depositor receives material via at least two separate inputs and uses a first displacement mechanism for displacing a first portion of the material provided by one input and a second displacement mechanism for displacing a second portion of the material provided by an other input. The first and second mechanisms are coupled together to cause volume of the second portion to vary according to volume of the first portion. The multi-outlet depositor may include a first source for providing material to the first input and a second source means for providing material to the second input, where one of the source is a non-positive displacement pump (i.e., a non-metered source). In addition, the material provided by the first source may be different than the material provided by the second source.

DETAILED DESCRIPTION OF THE PREFERRED EMBODIMENTS

Figure 1:
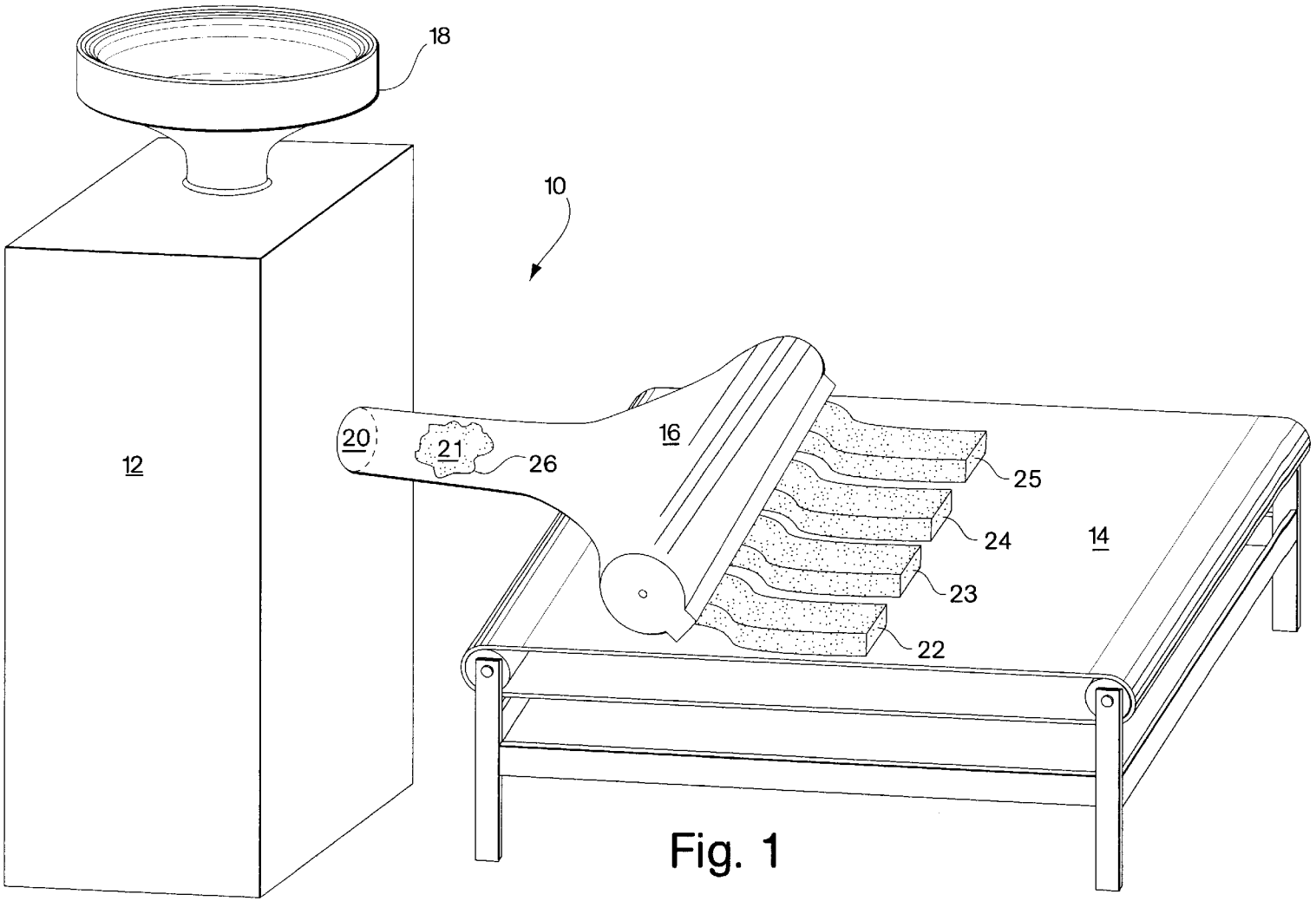
FIG. 1 is a food handling system employing a multi-outlet depositor according to the present invention.

Referring to FIG. 1, a food handling system 10 includes a food processing machine 12, a conveyor belt 14, and a multi-outlet depositor 16. The food processing machine 12 may be any one of a variety of conventional, commercially available food processing machines such as the Vemag Robot 500 food processing machines made by Vemag GmbH, a German company. The food processing machine 12 includes a funnel 18 for accepting food materials to be ground up, mixed, etc. by the food processing machine 12. The food processing machine 12 processes the material provided at the funnel 18 and provides the result thereof via a single outlet 20. The outlet 20 provides a fluid food material 21 having a paste-like consistency. The material 21 may include particulate matter of varying sizes depending on the type of food being processed.

The fluid material 21 from the outlet 20 is provided to the multi-outlet depositor 16 which divides the output into a plurality of portions 22–25. In the embodiment illustrated in FIG. 1, the portions 22–25 are substantially equal in volume. However, as described in more detail below, the number and relative volumes of the portions may be adjusted.

The portions 22–25 are carried away from the multi-outlet depositor 16 via the conveyor belt 14. The conveyor belt 14 is powered using conventional means such as a motor (not shown). In addition, the portions 22–25 can be cut using a conventional pneumatic piston-driven blade (not shown) that cuts the portions 22–25 at the end of the depositor 16 so that each of the portions 22–25 is further subdivided into a plurality of subportions. A cut-away 26 in FIG. 1 shows the single output stream of fluid material 21 provided by the food processor 12 via the outlet 20. Note that if the blade cuts each of the portions 22–25 at the same time, and each of the portions 22–25 is substantially equal to each of the other ones of the portions 22–25, then each of the subportions will be substantially equal to each of the other ones of the subportions.

Figure 2:
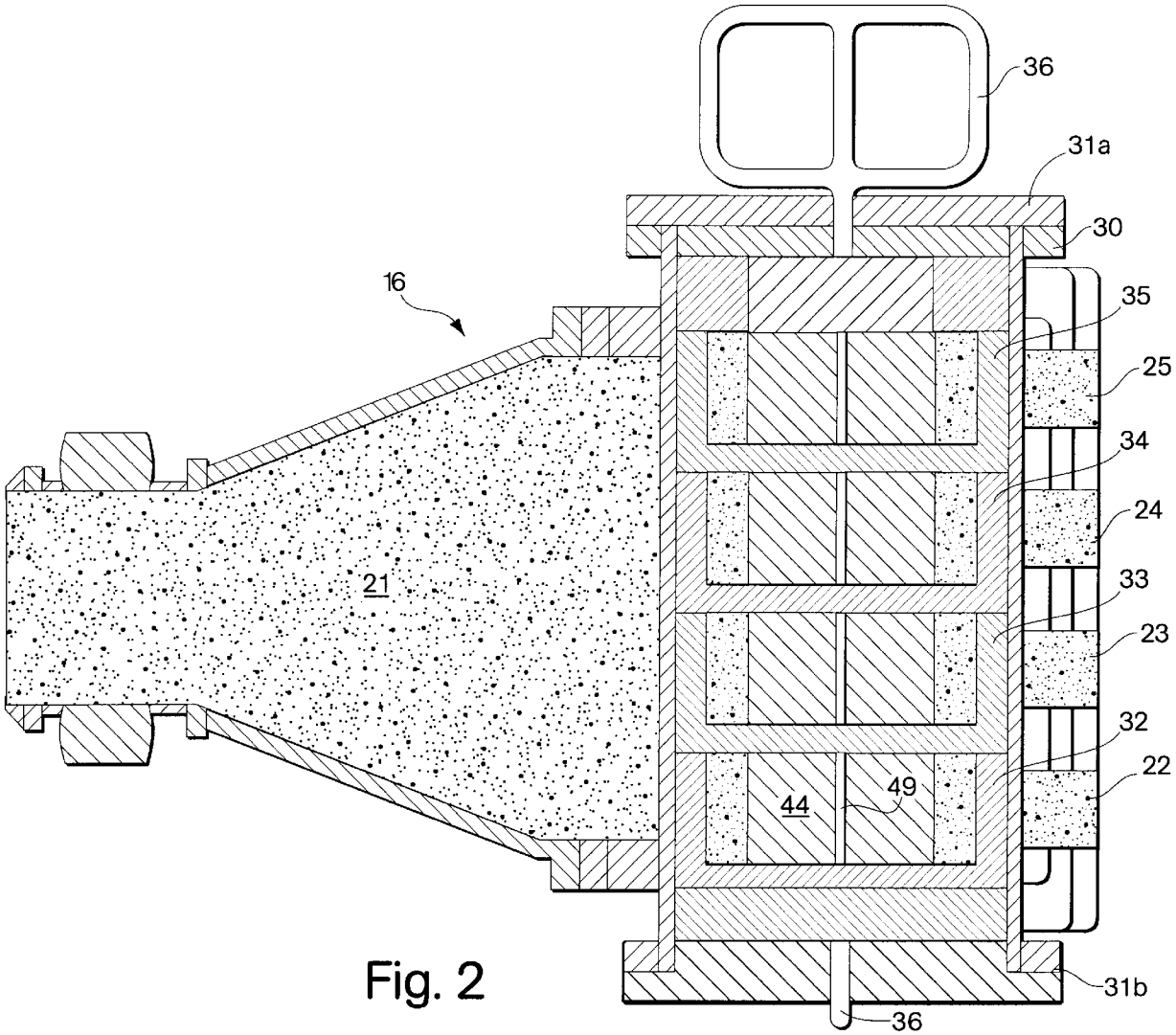
FIG. 2 is a top, cut-away, view of a multi-outlet depositor according to the present invention.

Referring to FIG. 2, the multi-outlet depositor 16 is illustrated in a top, cut-away, view showing the stream 21 being divided into the portions 22–25. The multi-outlet depositor 16 includes a non-moving stainless steel cylindrical section 30 having a pair of end plates 31*a,* 31*b* fixedly attached thereto. The cylindrical section 30 contains four disk-shaped hub/chamber assemblies 32–35. Each of the hub/chamber assemblies 32–35 provides a single one of the portions 22–25 so that, for example, the hub/chamber assembly 32 provides the portion 22 while the hub/chamber assembly 33 provides the portion 23, etc. A stainless steel locking rod 36 passes through holes in the end plates 31*a,* 31*b* and holes in each of the hub/chamber assemblies 32–35 in order to prevent the entirety of each of the hub/chamber assemblies 32–35 from rotating within the chamber 30. In alternative embodiments, it is possible to employ other conventional mechanisms, familiar to one of ordinary skill in the art, to prevent the entirety of each of hub/chamber assemblies 32–35 from rotating within the chamber 30.

Figure 3:
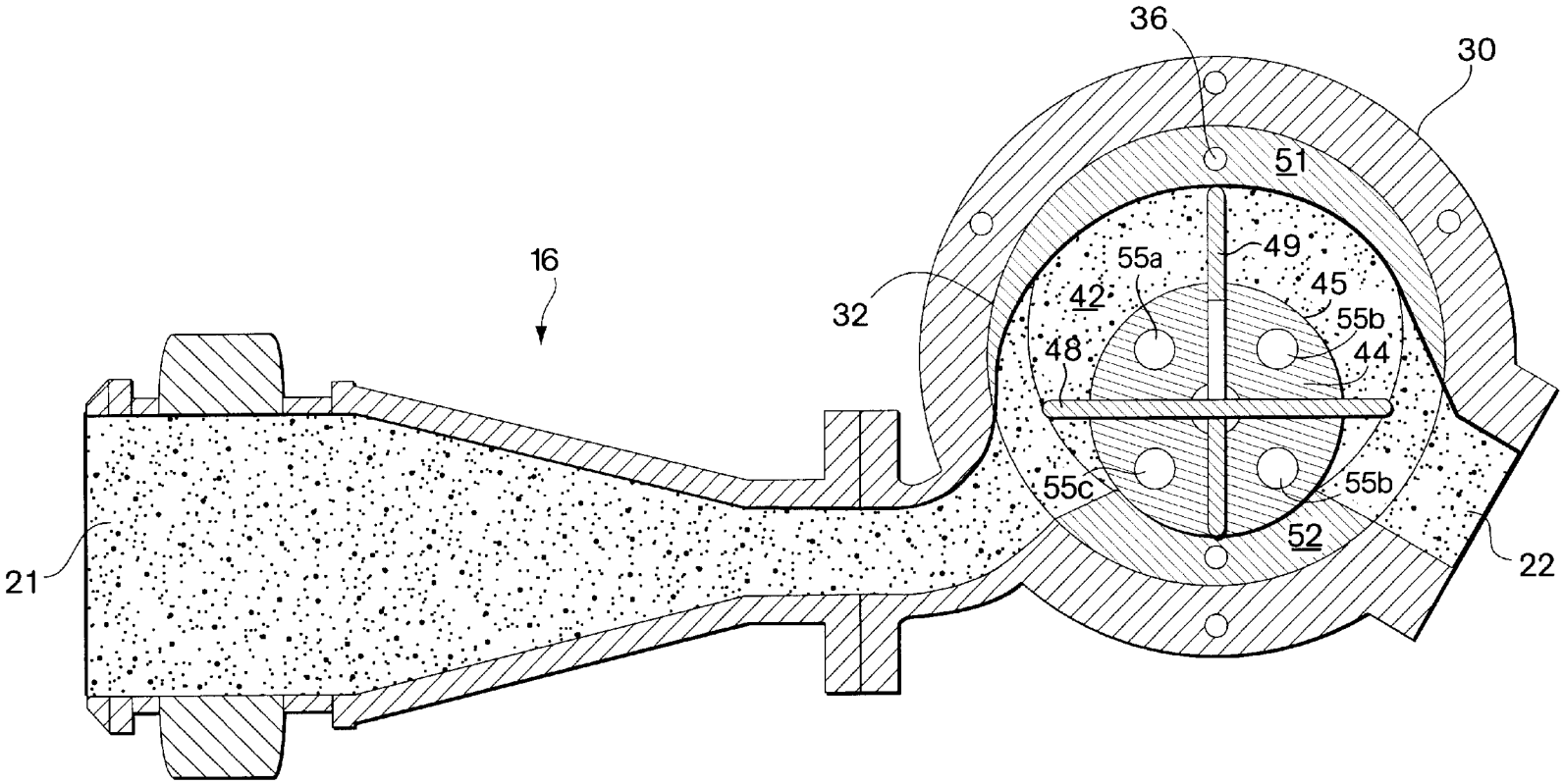
FIG. 3 is a side, cut-away, view of a multi-outlet depositor according to the present invention.

Referring to FIG. 3, a cut-away side view of the depositor 16 illustrates operation of the hub/chamber assembly 32 that provides the portion 22. The other ones of the hub/chamber assemblies 33–35 are similar to the hub/chamber assembly 32 shown in FIG. 3.

The hub/chamber assembly 32 includes a chamber 42 and a hub 44. The hub 44 is substantially disk-shaped and is configured to rotate about a central axis thereof within the chamber 42. The hub 44 is positioned within a hole 45 in the chamber 42 so that lateral faces of the hub 44 are coplaner with lateral faces of the hub/chamber assembly 32.

The hub 44 also includes a pair of vanes 48, 49. Each of the vanes 48, 49 is configured to slide along a longitudinal axis thereof within the hub 44. However, as described in more detail hereinafter, the vanes 48, 49 are interlocked so as not to slide entirely out of the hub 44. As the hub 44 rotates, ends of the vanes, 48, 49 slide against and are guided by outer portions 51, 52 of the hub/chamber assembly 32 and by a track formed within the chamber 42 via a depression 54. Note that although each of the vanes 48, 49 slides back and forth within the hub 44, the distance from one side of the depression 54 to another side of the depression 54 through each of the vanes 48, 49 remains substantially constant. The parts of the hub/chamber assembly 32 may be made out of a stiff plastic, such as white delrin, except the vanes 48, 49 which may be made out of stainless steel.

The hub 44 also includes a plurality of holes 55*a–d* disposed transversely through the hub 44. Each of the holes 55*a–d* aligns with holes in hubs of the other hub/chamber assemblies 33–35. A set of bolts or other coupling means (not shown in FIG. 3) can be placed into the holes 55*a–d* and into holes of hubs in the other hub/chamber assemblies 33–35 to cause all the hubs to rotate together, as described in more detail hereinafter.

Figure 4:
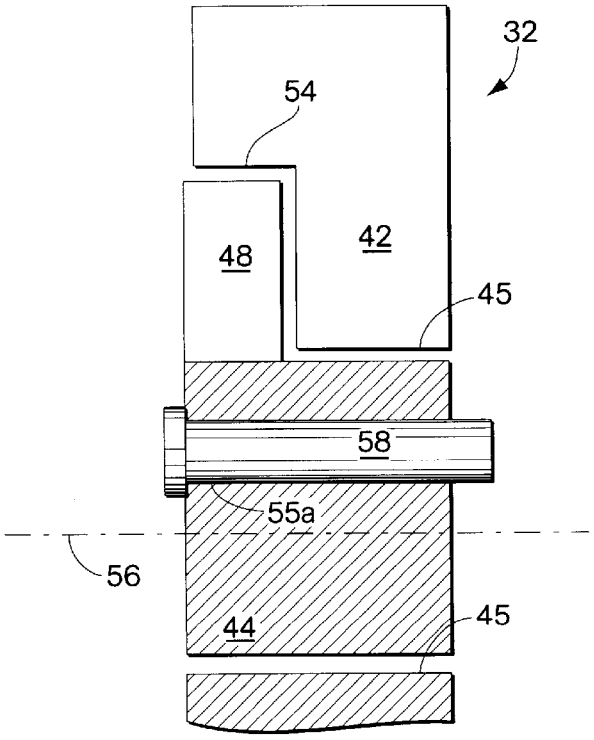
FIG. 4 is a front, cut-away, view of a hub/chamber assembly for the multi-outlet depositor.

Referring to FIG. 4, a subassembly drawing of FIG. 3 shows a cut-away front view of the hub/chamber assembly 32 that illustrates relationships between various components thereof. In FIG. 4, the hub 44 is shown positioned within the hole 45 of the chamber 42 while the vane 48, which extends from the hub 44, is shown positioned within the depression 54. FIG. 4 also shows an axis of rotation 56 of the hub 44. The axis of rotation 56 is perpendicular to the view shown in FIG. 3.

FIG. 4 also shows one of the holes 55*a* that passes through the hub 44. A bolt 58 is threaded through the hole 55*a* in a manner so as to pass through the hole 55*a* and through corresponding holes in hubs of the other hub/chamber assemblies 33–35. The bolt 58 passing through the hole 55*a,* along with other bolts (not shown) passing through the other holes 55*b–d,* cause all of the hub/chamber assemblies 32–35 to operate in concert so that the volume of material 21 output by the hub/chamber assembly 32 is nearly identical to the volume of material provided by the other ones of the hub/chamber assemblies 33–35. In the event that undesirable back pressure builds up at one of the hub/chamber assemblies 32–35, the mechanism for causing all of the hub/chamber assemblies to rotate in concert will help to ensure that the back pressure does not cause one of the hub/chamber assemblies 32–35 to output a volume different than that of the other ones of the hub/chamber assemblies 32–35. Each of the hub/chamber assemblies 32–35 acts as a positive displacement vane pump that is driven by the input fluid material 21 to provide a specific volume that varies according to the amount of rotation.

Figure 5A:
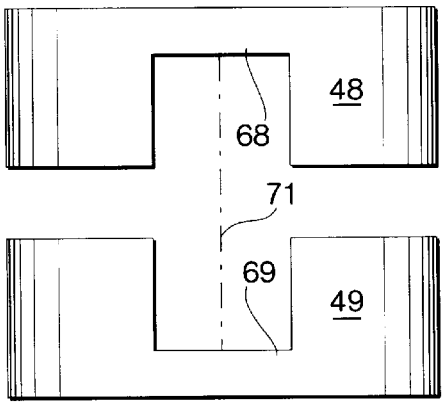
FIGS. 5A and 5B show vanes of the multi-outlet depositor.

Referring to FIG. 5A, the vane 48 is shown with a thin section 68 while the vane 49 is shown with another thin section 69. The thin sections 68, 69 are brought together as illustrated by a dashed line 71 in order to facilitate interlocking of the vanes 48, 49.

Figure 5B:
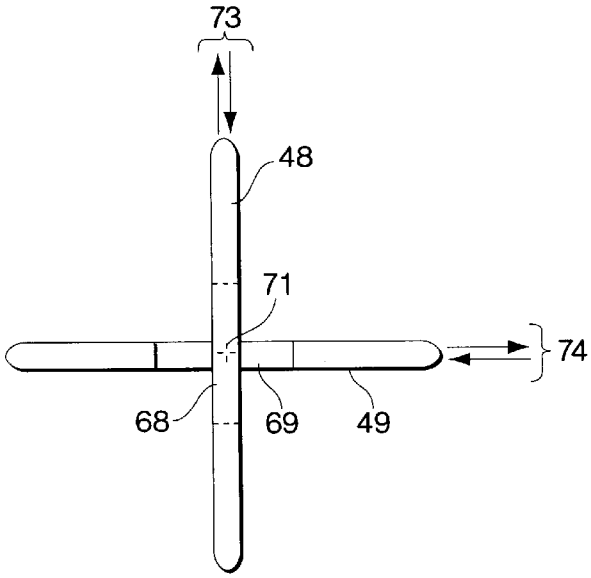

Referring to FIG. 5B, interlocking of the vanes 48, 49 using the thin sections thereof 68, 69 is illustrated. Note that when the vanes 48, 49 are interlocked in this fashion, then the vane 48 can slide back and forth along a longitudinal axis thereof as indicated by a pair of arrows 73. Similarly, the vane 49 can slide along a longitudinal axis thereof as indicated by a second pair of arrows 74. However, neither of the vanes 48, 49 will slide past an edge of the thin sections 68, 69, thus preventing the vanes 48, 49 from sliding out of the hub 44.

Figure 6:
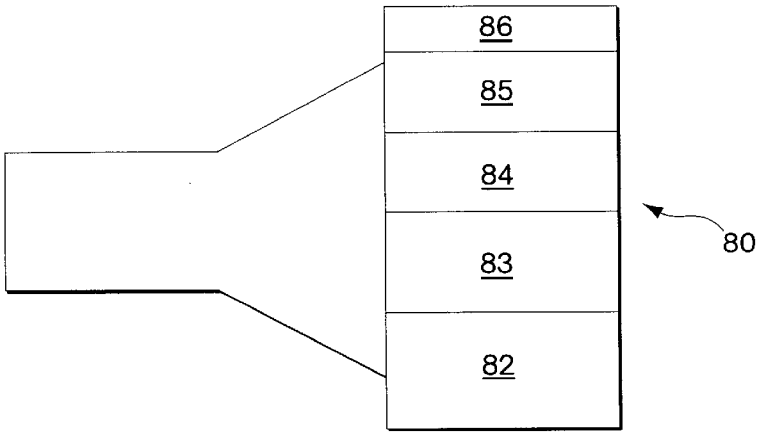
FIG. 6 is a top, schematic, view illustrating a multi-outlet depositor having unequal outputs.

Referring to FIG. 6, a top, cut-away, view shows a multi-outlet depositor 80 having five chambers 82–86. The view of FIG. 6 is similar to the view for the multi-outlet depositor 16 in FIG. 2, but FIG. 6 contains less detail than FIG. 2. Note that in the case of the multi-outlet depositor 80, the chamber 82 is wider than the chambers 83–86. This causes the chamber 82 to output more material than each of the chambers 83–86. However, if the chambers 82–86 are configured similar to the chambers 32–35 illustrated above in connection with the multi-outlet depositor 16 (i.e., if the chambers 82–86 are configured to cause the hubs thereof to rotate in concert), then the output of the chamber 82 will be proportional to the output of each of the chambers 83–86.

Figure 7:
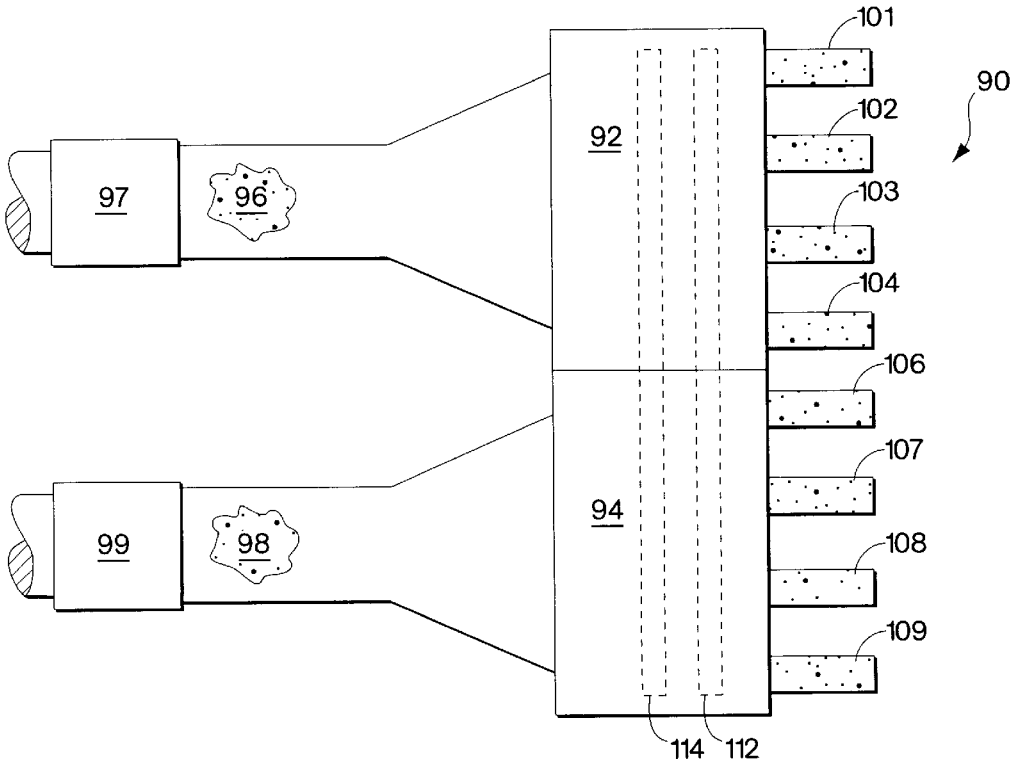
FIG. 7 is a top, schematic, view illustrating a tandem multi-outlet depositor.

Referring to FIG. 7, a tandem multi-outlet depositor 90 includes a first subassembly 92 and a second subassembly 94. The first subassembly 92 is provided with fluid material 96 from a first source 97 while the second subassembly 94 is provided with fluid material 98 from a second source 99. The first subassembly 92 outputs a plurality of portions 101–104 of the material 96 while the second subassembly 94 provides a plurality of portions 106–109 of the material 98. In the embodiment illustrated herein, none of the portions 101–104 contain any of the material 98 and none of the portions 106–109 contain any of the material 96.

The subassemblies 92–94 contain hub/chamber assemblies similar to the hub/chamber assemblies 32–35, 82–86, discussed above. The hubs of the hub/chamber assemblies contained in each of the subassemblies 92, 94 are bolted together using a plurality of bolts, 112, 114 (or other coupling means) in a manner similar to that disclosed above in connection with the multi-outlet depositor 16, so that the total volume output of the subassembly 92 is substantially proportional to the total volume of output of the subassembly 94. That is, since all the hub-chamber assemblies of both subassemblies 92, 94 rotate in concert, then the volumes of the portions 101–104 is substantially proportional to the volumes of the portions 106–109.

Note that it is possible for both of the sources 97, 99 to include positive displacement pumps. In that case, however, the volume outputs of the pumps 97, 99 must be synchronized so that the relationship between the volumes of the materials 96, 98 that are provided per unit time remains substantially constant. Alternatively, in a preferred embodiment, one of the materials 96, 98 may be provided by a positive displacement pump (such as a piston pump) while the other one of the materials 96, 98 is provided by a non-positive displacement pump, such as a centrifugal pump. For example, the source 97 may be a piston pump while the source 99 is a centrifugal pump. In that case, the material 96 would drive both subassemblies 92, 94 while the material 98 would be supplied to the subassembly 92 as needed so that, as described above, the volumes of the portions 101–104 are substantially proportional to the volumes of the portions 106–109.

The configuration shown in FIG. 7 is useful in cases where a food product being manufactured has more than one ingredient that needs to be provided in a proportional manner. In those situations, the first and second materials 96, 98 may be provided by separate food processing machines or other similar means for delivering the food product to the subassemblies 92, 94. In the case of two separate ingredients that are to be combined, then, for example, the portion 101 can be combined with the portion 106, the portion 102 can be combined with the portion 107, the portion 103 can be combined with the portion 108, and the portion 104 can be combined with the portion 109.

Figure 8:
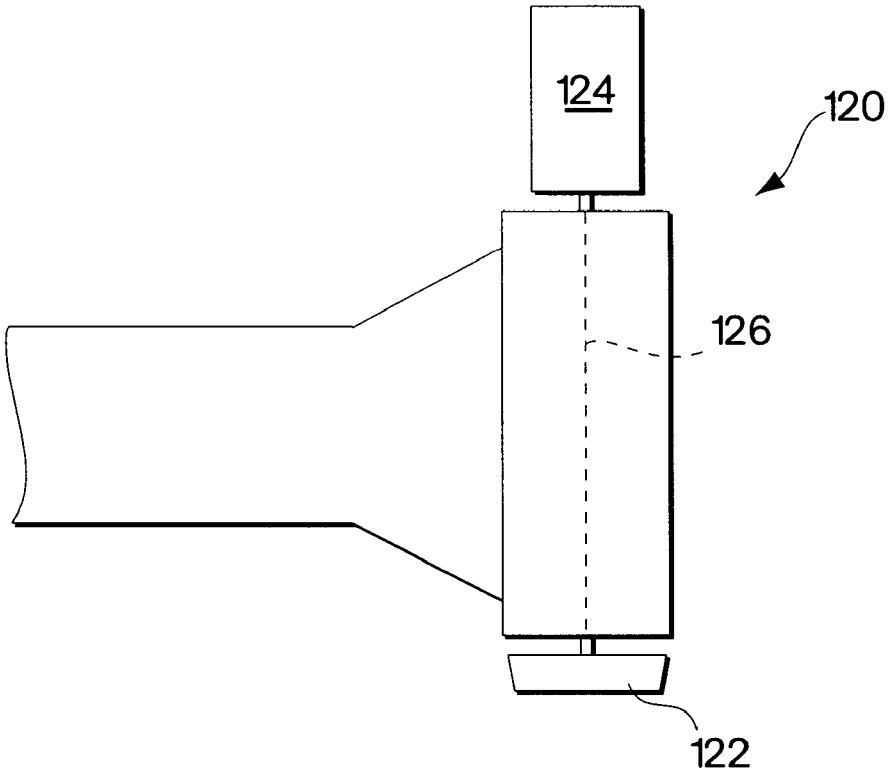
FIG. 8 shows a multi-outlet depositor connected to a motor and an air brake.

Referring to FIG. 8, a multi-outlet depositor 120 is shown with an air brake 122 and a motor 124 attached thereto. In situations where the back pressure provided by the combination of the multi-outlet depositor 120 and the food processor connected to the multi-outlet depositor is too little, then the air brake 122 can be connected to an axle 126 that passes through the center portions of the hubs and rotates in a fixed relationship with the hubs. The air brake 122 will thus resist rotation of the hubs of the multi-outlet depositor 120 and develop an appropriate back pressure.

Similarly, in situations where the back pressure provided by the material that is separated with the multi-outlet depositor 120 is too great when the hubs of the multi-outlet depositor 120 are allowed to rotate freely, positive rotation provided by the motor 124 will reduce the back pressure provided by the multi-outlet depositor 120. For a particular material being provided to the multi-outlet depositor 120, it is probably the case that either the air brake 122 or the motor 124 will be employed to the exclusion of the other. This is because a specific material will, in all likelihood, either cause the back pressure to be too great (in which the case the motor 124 is used) or too little (in which case the air brake 122 is used).

Although the invention has been illustrated herein in connection with processing food material, it will be appreciated by one of ordinary skill in the art that the invention may be used to process any homogeneous or non-homogeneous fluid material that may or may not contain particulate matter. In addition, although the invention has been illustrated using various numbers and configurations of chambers, inlets, and outlets, it will be appreciated by one of ordinary skill in the art that the invention may be practiced using different numbers and configurations of chambers, inlets and outlets.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A multi-outlet depositor, comprising:

input means for receiving fluid materials;

first displacement means for displacing a first portion of the material provided by said input means;

second displacement means for displacing a second portion of the material provided by said input means, said second and first displacement means having portions thereof rotating in concert;

coupling means for coupling said first displacement means to said second displacement means to cause volume of said first portion to vary according to volume of said second portion;

an axle, attached to said first and second displacement means to rotate in concert with said first and second displacement means; and resistance means, attached to said axle, for providing resistance to rotation of said first and second displacement means;

wherein said resistance means is an air brake.

2. A multi-outlet depositor, comprising:

first and second input means for receiving fluid material;

first displacement means in fluid communication with at least one of said first and second input means for displacing a plurality of continuous portions of the material provided by at least one of said first and second input means;

second displacement means in fluid communication with at least the other of said first and second input means for displacing a plurality of continuous portions of the material provided by at least the other of said first and second input means; and coupling means for coupling said first displacement means to said second displacement means to cause the plurality of continuous portions from said first displacement means to vary according to the plurality of continuous portions from said second displacement means.

3. A multi-outlet depositor, according to claim 2, further comprising:

a first source means for providing material to said first input; and a second source means for providing material to said second input, wherein one of said first and second source means is a non-positive displacement pump.

4. A multi-outlet depositor, according to claim 3, wherein the material provided by the first source means is different than the material provided by the second source means.

5. A multi-outlet depositor, comprising:

input means for receiving a single stream of fluid material;

first displacement means in fluid communication with said input means for displacing a first portion of the single stream of fluid material provided by said input means;

second displacement means in fluid communication with said input means for displacing a second portion of the single stream of fluid material provided by said input means, said second and first displacement means having portions thereof rotating in concert;

coupling means for coupling said first displacement means to said second displacement means to cause volume of said first portion to vary according to volume of said second portion;

an axle, attached to said first and second displacement means to rotate in concert with said first and second displacement means; and resistance means, attached to said axle for providing resistance to rotation of said first and second displacement means;

wherein said resistance means is an air brake.

* * * * *